US005839452A

United States Patent [19]

Sarwar

[11] Patent Number: 5,839,452

[45] Date of Patent: Nov. 24, 1998

[54] HAIR ORNAMENT

[76] Inventor: Balarie Sarwar, 4333 Latona Ave., Los Angeles, Calif. 90031

[21] Appl. No.: 505,559

[22] Filed: Jul. 21, 1995

Related U.S. Application Data

[63] Continuation of Ser. No. 109,238, Dec. 10, 1993, abandoned.

[51] Int. Cl.[6] ..... A45D 8/12

[52] U.S. Cl. ..... 132/275; 132/271; 132/277; 132/278; 132/279

[58] Field of Search ..... 132/275, 276, 132/277, 278, 279; D28/39, 40, 41, 42, 43; 63/29.1, 2, 12, 13

[56] References Cited

U.S. PATENT DOCUMENTS

| | | | |
|---|---|---|---|
| D. 202,437 | 9/1965 | Benjamin | D28/42 |
| D. 220,460 | 4/1971 | Hawkins | D28/42 |
| D. 261,181 | 10/1981 | Sands | D28/41 |
| 859,797 | 7/1907 | Bechtold | 132/279 |
| 956,991 | 5/1910 | Nathanson | 132/279 |
| 2,361,772 | 10/1944 | Kaplan | 132/275 |
| 2,567,583 | 9/1951 | Stromer | 132/275 |
| 3,418,194 | 12/1968 | Loftice | 132/75 |
| 5,355,698 | 10/1994 | Edmark | 63/29.1 |

FOREIGN PATENT DOCUMENTS

| | | | |
|---|---|---|---|
| 0384790 | 4/1908 | France | 132/279 |
| 0625467 | 8/1927 | France | 132/279 |
| 161262 | 3/1921 | United Kingdom | 132/279 |

OTHER PUBLICATIONS

Mademoiselle, p. 134, D28–43, Feb. 1973.

*Primary Examiner*—Gene Mancene
*Assistant Examiner*—Pedro Philogene
*Attorney, Agent, or Firm*—Lawrence S. Cohen

[57] ABSTRACT

A hair ornament which is made entirely of natural materials.

3 Claims, 1 Drawing Sheet

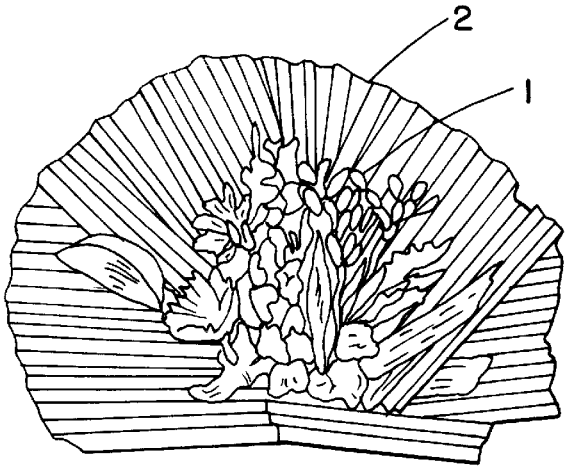
Fig. 1
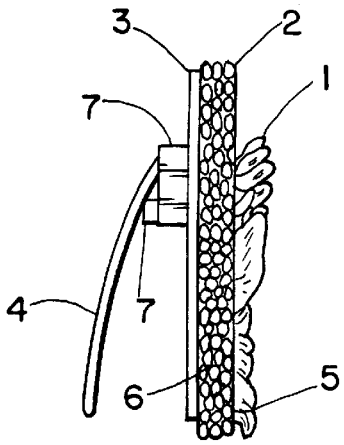
Fig. 2
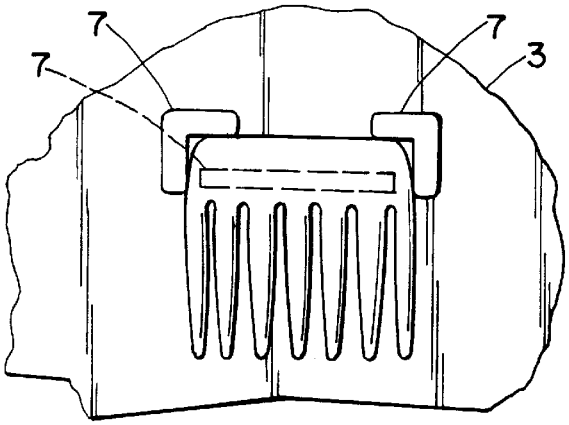
Fig. 3
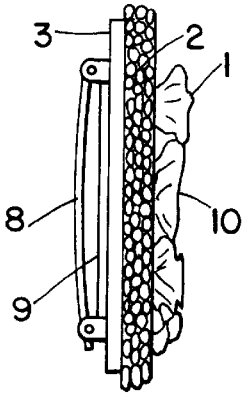
Fig. 4
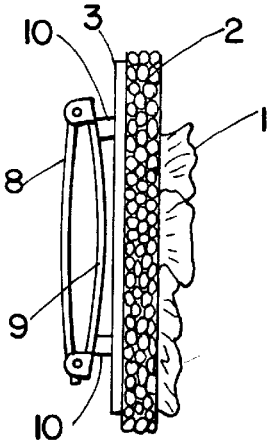
Fig. 5
Fig. 6
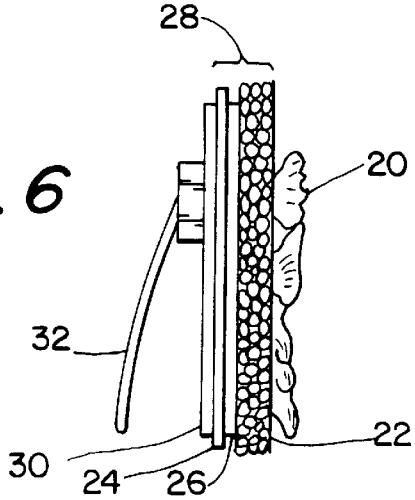

HAIR ORNAMENT

RELATED APPLICATIONS

This is a Continuation of application Ser. No. 08/109,238 filed on Dec. 10, 1993, the content of which is incorporated herein now abandoned.

FIELD OF THE INVENTION

This invention relates to hair ornaments. Prior hair ornaments consist of a means to hold the ornament onto the wearer's head, and the ornamentation selected, which are joined together. Such hair ornaments in the past are constructed of many man-made items, gemstones, rare metals (gold or silver) or animal parts, such as ivory and tortoise shell which have been processed for the application.

SUMMARY OF THE INVENTION

The present invention is a hair ornament in which all of the ornamentation is of natural vegetable matter. The ornamentation is mounted on a platform which is similarly of natural vegetable material, and which may also be formed for ornamental effect. Under the platform is a sub-platform of soft natural vegetable material which prevents the user's hair from becoming entangled in the platform material. The platform may be built-up of a sandwich having an inner core and outer layers of platform material. The term "vegetable" material includes all earth-growing materials, that is all plant materials.

BRIEF DESCRIPTION OF DRAWINGS

FIG. 1 shows a plan view of a hair ornament embodiment of the present invention.

FIG. 2 shows a side view of a hair ornament embodiment of the present invention.

FIG. 3 shows a partial back view of a hair ornament embodiment of the present invention.

FIG. 4 shows a side view of a hair ornament embodiment of the present invention.

FIG. 5 is a side view of a hair ornament embodiment of the present invention.

FIG. 6 is a side view of a hair ornament embodiment of the present invention.

DESCRIPTION OF THE PREFERRED EMBODIMENTS

Referring to FIGS. 1, 2 and 3 the preferred embodiment of the present invention comprises ornamentation material 1, mounted on the top of a platform 2, a sub-platform 3 mounted on the bottom of the platform 2, and a hair mount means 4. In particular, the ornamentation material 1, may be, nuts, buds, flowers, petals, or any natural vegetable material selected. The platform 2 has a top surface 5 and a bottom 6. The platform 2 may be made of barks, stems, or grasses adhered together. The ornamentation material 1 is adhered to the top surface 5. Adhered to the bottom surface 6 of the platform 2 is a sub-platform 3 which is preferably a single piece of soft bark or banana leave or other soft material. The hair mount means 4 can be adhered to the sub-platform 3. However, because the platform is more rigid and stronger, it is preferable to provide an opening in the sub-platform 3 so that the hair mount means 4 can be adhered directly to the bottom of the platform 2. Supporting structure 7 of wood pieces may be employed to strengthen the mounting of the hair mount means 4 to the item.

The hair mount means 4 may be a comb as illustrated, a barrette, a pin, or any of the other commonly known means for mounting an ornament in the hair.

Referring to FIG. 4 there is shown a side view of a hair ornament of the present invention in which a barrette 8 is used. In this embodiment the barrette 8 is adhered either to the platform 2 or to the sub-platform 3. The barrette 8 shown has a curved base 9, and therefore the platform 9 is curved accordingly. FIG. 5 is alternative in which the barrette 8 is adhered to the platform 9 supplemented by use of supports 10, so that the platform does not have to follow the curve of the base 9.

The platform is rigid. It is preferably constructed of fibrous material of elongated shape having limited flexure such as straw, grasses (such as lemon grass), stems, branches, and the like, adhered together to form a single rigid platform. Consequently, there are usually strong or loose fibers and rough ends in which the user's hair can become tangled.

Use of the sub-platform 2 is important because it provides a barrier between the user's hair and the platform 2. As noted, without the sub-platform 3 there is likelihood that the user's hair will become entangled in the platform 2. For example, if straw or stiff grasses are adhered together to form the platform 2 it has a tendency to tangle with the hair. Therefore use of the soft sub-platform 3 provides the separation needed to avoid this. The material should be smooth so as to prevent tangling. Some such soft smooth materials can be like chamois to the touch. One such material is known as melaleuca leucondron which comes from the cagiput tree also known as the paper bark tree. They should be applied to form a continuous element with no spaces, except where the hair mount means 4 is to extend through to be adhered to the platform 2. One or more pieces can be used to make the sub-platform 3 trimmed to the outline of the platform 2 or somewhat smaller than the platform so that it will not be visible when worn.

In a preferred embodiment, an inner core of flat material is used on each side of which the platform material is applied to form a three piece sandwich-type platform. That is, there is an upper layer which will provide the upper surface of the platform on which the decorative material will be placed, an inner core, and a lower layer which will provide the lower surface of the platform for receiving the mounting means and the sub-platform. The inner core may be made of soft bark or any other natural relatively flat material. The material can be rigid or somewhat flexible. It is best that the inner core not be visible at the edges of the platform, so it should be smaller than the intended peripheral size of the upper and lower layers. The layers are joined by an adhesive. An important property of the inner core is that it establishes good adhesion with the adhesive used to form the sandwich.

FIG. 6 shows an example of this arrangement. The ornamentation material 20 is mounted on an outside platform layer 22 of natural material as described above. An inside platform layer 24 is also of natural material as described above. Between the outside platform layer 22 and the inside platform layer 24 is an inner core 26. These three pieces are adhered to form an integral platform 28. On the back of the inside platform layer 24 is a sub-platform 30 as described above and a hair mounting means 32, also as described above.

The platform should be given a decorative or artistic shape. A simple circular shape or basket with stems are examples. FIG. 1 shows an example.

The culture of many peoples of the world have a spiritual aspect of connection to the natural world in which they live.

Such a spiritual-nature connection is demonstrated by a story hereafter recited. The present invention is intended to offer a personal emotional contact by the wearer with this spiritual-nature connection.

The story is:

FORWARD

ALL OF NATURE IS WORTH SALVAGING

Tropical people toiled and harvested vast lands, within and near the equatorial boundaries. Humble people. Second and third-class citizens. Always poor but always happy! "Blessed are the peacemakers for they shall inherit the earth".

Caribbean delicacies are a re-creation of foodstuff such as spices, fruits and vegetables and many other plants that have dried and withered.

Not any fruit of life is useless or should be wasted. For the reason of salvage and love, Caribbean delicacies took form. Foodstuff, spices, and plant re-creations have become novelty items such as hair combs and barrettes. They somehow naturally compliment and express people of color.

In historic retrospect, african expressions, according to identity, economic conditions and status, has for the most part, been a plight of poverty. Within the tropical-african communities, clothing was salvaged, from thrown out to hand-me-downs. But, nevertheless, there remains a genuine fruitfulness in colors when worn by a person having tropical skin.

Fabric and colors appear so delicate and there is still that common bond with nature . . . Complimenting the people who have toiled under the sun, salvaging themselves and all of life with love and a happy fruitful spirit.

Yes, they were a happy people! Always laughing, singing and dancing. They were field laborers. Working in the sugar cane fields. Sugar can was not the only produce on the islands in which they toiled. There were other produce, such as rice, beans, watermelon, mangoes and other tropical fruits.

There was, however, a problem with the people and their land. The islands were not fertile enough, and for this reason it became known as the "Virgin Islands", a tropical paradise, in the West Indies that had not produced in ten years.

On one of the islands lived a little black girl known as Ylova, which means "secret song" in the old dialects of the islands. Ylova was very enchanting in her soft manners and sweet voice. She had beautiful kinky hair with soft tiny kinks around the edges of her hairline and temple. Her beautiful, thick eyebrows added to her enchantment as did her kinky-curled eyelashes which trimmed her deeply-set, dark-brown eyes.

What a happy little girl Ylova was. She was the youngest of three brothers and two sisters. Sadly, though, Ylova's family was very poor. The six children with both parents lived in a two room shack.

Ylova dressed in ragged clothes many of them she got from the two incinerators which the well-to-do had thrown out. She somehow had an excellent knack for putting things together and making them look lovely. Even her ragged stitches and pins she used to piece her clothes together looked remarkably fine. So much that her sisters wanted her to do the same for their salvaged clothing.

When Ylova's family worked in the field, Ylova's sisters and brothers would sing the most joyful, rhythmic songs. Songs that would call the wilds of Africa to join in. Her brothers' voices were as sounds of thunder and volcanic eruptions. Her sisters voices were like trickling raindrops that had fallen into a subtle flow of ocean waves, carried off by a soft gentle breeze.

Ylova's voice was the softest. Her pitch was high and gentle, yet, serene as the seclusiveness of a far away waterfall. Tropical birds of all kinds and plumage listened to the enticing music and watched sunburnt bodies dance and sway to the vibrations of life. And, when night fell, the black dancing bodies retired, blending into night's darkness and peaceful refrain of stillness. "Get up! Get up!" their mother called out to them the following morning. When the children arose, their parents began to talk of the upcoming Jamaican Produce Festival. This festival took place every summer and all islands in the West Indies and Caribbean would go to Jamaica with the best produce, voluptuously appealing, flawless and remarkably tasty. And the best produce from one of the islands would win. There would be an exchange of culture, song and dance. And most of all, the great produce would attract the most merchants and traders bringing wealth to the chosen island. Ylova's mother told her children to work hard in the field and that maybe a miracle would happen making the Virgin Islands the winners of the upcoming festival, which takes every summer.

All the family worked harder in the field, but the land was barren of some vegetables and fruit. It was now late spring, and, that which did grow, was not mature enough, had not ripened and had fallen to the ground. Ylova salvaged many of the fallen fruits and vegetables. As she worked in the field with her sisters and brothers, she would make hair ornaments from the salvaged produce. As she would sign and dance wearing one of the items. Her sisters and brothers laughed at her saying she was silly and looked ridiculous. On this particular day, Ylova, entranced, looked sadly in a stare at the salvaged produce. Within moments, she quietly went to work. Something was on Ylova's mind.

That night, Ylova prayed and asked God to bless the "Virgin Islands" produce. From that night on, Ylova continued in her prayers, when she awakened each morning and before she went to bed. Within a month, fruits and vegetables began to sprout out from their stalks. Funny thing though, it was only the field in which Ylova's family worked that grew, . . . and how wonderfully appealing! Townspeople came to see the miracle and wanted to know the secret, but none of the family members knew. Then Ylova stepped forward explaining that when she began praying each day at sunrise and then again at sundown, asking God to bless the produce, was when this miracle started. The villagers all looked very puzzled and quietly walked away.

When all the villagers on the "Virgin Islands" began to pray and asked for God to bless their produce, the miracle spread. All of the produce grew at an astounding rate, and were miraculously enormous in size and color.

This was the dawning of a new day! All of the people on the Virgin Islands began to prepare for the Jamaican Produce Festival. Baskets were being woven and exchanged just as recipes and other craft were. Aroma filled the air as the women of the village cooked large pots of stew filled with tasty vegetables and spices. Homemade bread and pies were set in opened windows, and sweetness drifted into mid air attracting traders and merchants who had not done business with the Virgin Islands for years.

Now, Ylova became better in her salvaging of fruits, vegetables. She also began salvaging spices, natural plants and flowers, pasta and beans, creating many naturally beautiful hair ornaments for herself, her sisters and other females on the Virgin Islands.

Two days before the Jamaican Produce Festival, many Banana Boats came and anchored at the village wharfs. The young women looked elegant in their salvaged dresses pinned with gold safety pins, having a variation of hemmings, threadings and patchwork. Floral, fruit and vegetable designs were imprinted on their salvaged dresses. These designs were made with the stains of fruit and vegetable juices and flower secretion. Some of the designs imprinted on the dresses and headrags were chili peppers, strawberries, bananas, and tropical flowers.

The smell of summer filled the air! Each of the women wore a fruit, vegetable or floral-stained headrag clamped closed with on of Ylova's beautiful, natural hair ornaments. And, what beautiful baskets they carried on top their heads as they boarded the banana boats. The baskets were filled with luscious fruits and vegetables and squash, corn, rice, flour, watermelons, bananas, pears, beans, nuts, chili peppers, pineapples, mangoes, guavas and coffee. The gold earrings that each of the young women wore looked so very exquisite and elegant against their tropical skin tones.

The young men wore cotton, tropically-designed shirts stained with fruit and vegetable juices. They wore seaweed-dyed cotton pants and on their heads, each of them wore a straw hat.

One young man took off his hat to wipe the sweat from his brow and what a warm and blissful sight he was. His gorgeous, black-wooly hair and cocoa complexion highlighted all the other tropically colored and flavored men who stood beside him, i.e, banana cream, molasses, peach, pear and coffee. So, the men carried large crates of sugarcane and bunches of bananas and coconuts as they boarded the banana boats after the young women. Banana boats "ahoy" they went to the big festival.

When the Virgin Islanders arrived in Jamaica, all eyes were set on them. Already at the festivity were the Belizians, Honduranians, Puerto Ricans, Cubans, Haitians, Trinidadians, Barbadians, Bahamians, and Dominicans. The Virgin Islanders did look stunning, especially compared to previous years, and their produce looked appetizing too.

After produce from all the islands were tasted and examined for flaws, their appeal and enormous size, it was without a doubt that the Virgin Islanders were the winners!

Did they celebrate? Yes they did! The Virgin Islands would have a prosperous year and with continued prayer maybe many more years. During the festivity, they ate many native island foods, drank rum and danced many native dances. The men shook their heads and shoulders and kicked their legs up rhythmically to the beats of the drum. They pranced up and down, around and around while the young girls shook their shoulders, twirled their hips and rolled their stomachs to the sounds of the music. They danced as though the vials that had stored fertility had opened up and poured the spirit upon the people.

The following accessories and clothing are depictions of Ylova's natural or ragged, salvaged, pinned clothing that she wore:

Hair combs and ornaments represent the salvaged produce she put in her hair.

Spice combs, singularly and in combinations such as tumeric. There is even a tumeric brooch. There are so many spice combinations . . . ginger is also used in the decor, including banana chips and dried fruits.

Pasta combs with seashells, on Jamaican buggies, with cinnamon, macaroni, flower, bell, and oriental characters. Also, the berry plant across the pasta.

Also dried chili pods and pepper (Note: seeds are extracted!). Designs trimmed with gold, copper or brass paints, with painted leaves and a variation of leaf placements. There are specially processed for preservation.

Most extraordinarily is the leaf wrap. It goes around a braid of ponytail naturally and perfectly grasping and fitting. Veil material is in the innermost of the leaf wrap to allow for use of a hair or bobby pin. These are specially processed to give a wooden look and for preservation.

The designs on the T-shirts silhouetted with the use of black paint or black velvet are a depiction of "Black Island" people. The fruit, vegetable and florally-designed cloths are representative of "Blessed and Fertile" produce and land.

There is, however, much creativity used here with the use of the elastic, gold earrings for the ladies and the wooly, wire-filled braids used for the Jamaican man's dredlocks. Other creative methods include the half baskets on top of the women's heads adhered to the headrags with the use of Velcro. The use of real fisherman's net is another creative expression. Any, tiny, tiny, gold safety pins gives a ragged glamour to the T-shirts as they hold up shredded remnants. The patchwork blends in well and is also elegant. Wedding veil material, black and white as well as nylon screen are also used in patchwork for body ventilation and design. Also, the cutout britches that are the back sides of some T-shirts. The britches hanging in an opened space are clamped by large, gold safety pins.

The hats are complimentary in their jute-like, straw-like texture to the hat customs of the islands, however, the ones illustrated here are more elaborate in decoration. The brass, copper, and gold colors highlight the beauty of many topical tones on "Blackness"!

The rope is so naturally used around the larger hats. Dried and artificial flowers, feathers and potpourri pieces are used in decorations as well as craft hair curls (golden brown).

One very unusual hat is the Spaghetti hat with the Zebra-rope strap. It is a show piece.

On the smaller hats, the rope is featured and slightly painted giving a 2-tone natural look. Also, on some of the smaller hats are the Zebra rope designed straps. These smaller hats are really hair barrettes to be clamped to the back of a hair style, preferably ponytails, twisters, and a variation of braid styles.

The very small hats are ornamental with hand-stitched trimmings and on top black beans, black-eye peas and other spices.

Thus the invention, referred to as "Caribbean delicacies" is an environmental art form of hair accessories. The elements available for selection include, without limitation tree fragments, dried plant parts, foliage, potpourri, spices, dried fruits, seeds, peel, cinnamon sticks, pod, cones, berries, pasta, banana chips, leaf wrap, ginger, avocado, and orange peel, bark, and tumeric.

Prior to assembly the elements are preferably processed by the following steps:

A. Dried and eroded plants and fragments are washed in lukewarm to boiling water and may be soaked in over proof rum.

B. Washed and soaked plants are air dried.

C. With the use of cement, glue, acrylic, varnish, and or epoxy glue, or natural resins, depending on the condition and form of the components, the components are joined together in endless combinations of one kind or more to form a beautiful ornament.

D. Depending on the condition, porousness and tightness of the cohesion of the ornament components, a coating step may or may not be employed, such as painting or spraying with:

1. water seal; or
2. clear lacquer, varnish, or stain; or
3. polyurethane; or
4. clear acrylic coating; or
5. for bananas, spray with enamel paint such as black before step It is preferred that of steps 1–4, the combination of two or more is used to provide durability.

Also, for highlighting and accentuating the decorative aspects of the ornament, gold, brass, or copper enamel paint may be applied. Artificial cloth flowers, beads and stems may be used for decoration.

E. Each ornament, with the exception of many made of spices have for its sub-platform 4 smooth soft bark or soft dried banana leaves.

F. When a comb is used as a hair mount it is preferably tightly captured and glued between two or more small pieces of wood. These are called mounting fragments. They may be covered with one of the soft materials such as used for subplatforms, such as soft bark and banana leaves, by adhering with an adhesive.

G. When barrette clamps are used, the clamp is adhered with an adhesive such as acrylic varnish, cement, or epoxy glue. Barrettes are often curved and they may be mounted on a flat platform or sub-platforms by wood fragments at each end or at one end. Alternatively the platform may be made to conform to the shape of the barrette base.

In particular example to make a palm barrette the following procedure is recommended:

1. All parts are cleaning in hot soapy water.

2. Strips of dried palm leaves or dried lemon grass are glued individually around a small piece of soft bark. The soft bark defines an inner core; the palm leaves or lemon grass is applied on one side. This process continues until the front side is full and the bark is totally covered by the palm leaves or lemon grass. This can be the upper layer. It doesn't matter whether the upper or lower layer is constructed first.

3. Then, on the opposite side of the bark another build-up of the palm leaves or lemon grass is done again to completely cover the soft bark inner core. In this example this will be the lower layer. Thus the inner core is sandwiched between two layers of the outside material. Especially but not exclusively respecting the layer which will define the upper platform surface, attention is paid to the decorative appearance of the materials as they are adhered in place.

4. On the lower platform surface a barrette clamp or comb is attached.

5. A strip of soft bark is placed either around the barrette or under the comb, and if possible over other areas of the lower surface to inhibit tangling of the user's hair.

6. Fragment decor is adhered on the upper platform surface.

Although particular embodiments of the invention have been described and illustrated herein, it is recognized that modifications and variations may readily occur to those skilled in the art, and consequently it is intended that the claims be interpreted to cover such modifications and equivalents.

What is claimed is:

1. A hair ornamental device in which the primary ornamental portion is made entirely of natural materials comprising;

a mounting means for attaching the device to a user's hair;

a rigid platform element attached to the mounting means made substantially of a plurality of pieces of a natural fibrous vegetable material having limited flexure and being adhered together to form said platform and having an upper platform surface and a lower platform surface said upper and lower platform surfaces defining oppositely facing surfaces of said platform element said mounting means being attached to said lower platform surface;

at least one decorative element attached to the upper platform surface, said at least one decorative element being of a natural material which is different from the natural material of the platform element;

inner core layer of natural vegetable material adhered to said lower platform surface;

a subplatform element of smooth natural vegetable material applied over and attached to said inner core layer defining a layer of said subplatform element material between said platform and a user's hair when said device is attached to a user's hair by the mounting means and said subplatform and inner core layer having an opening and said mounting means is attached directly to said platform through said opening.

2. The hair ornamental device of claim 1 wherein said subplatform element material consists essentially of bark of the paper bark tree.

3. The hair ornamental device of claim 1 wherein said platform element is formed of a material selected from the group consisting of, dried palm leaves, grasses, stems and mixtures of grasses and stems.

* * * * *